US006481133B1

(12) United States Patent
DeSena

(10) Patent No.: US 6,481,133 B1
(45) Date of Patent: Nov. 19, 2002

(54) SHELF PRODUCT MANAGEMENT AND INFORMATION DISPLAY

(75) Inventor: Michael D. DeSena, West Caldwell, NJ (US)

(73) Assignee: Henschel-Steinau, Inc., Englewood, NJ (US)

( * ) Notice: Subject to any disclaimer, the term of this patent is extended or adjusted under 35 U.S.C. 154(b) by 15 days.

(21) Appl. No.: 09/812,004

(22) Filed: Mar. 19, 2001

(51) Int. Cl.[7] ..... G09F 3/18; G09F 3/20

(52) U.S. Cl. ..... 40/661.03; 40/649; 40/653; 40/661.06

(58) Field of Search ..... 40/124.05, 124.07, 40/642.02, 649, 650, 653, 661.03, 661.06, 661.07, 661.11

(56) References Cited

U.S. PATENT DOCUMENTS

| | | | | |
|---|---|---|---|---|
| 2,532,028 A | | 11/1950 | Mapson et al. | |
| 3,320,690 A | | 5/1967 | Forsburg | |
| 3,889,408 A | | 6/1975 | Offner | |
| 4,688,341 A | | 8/1987 | Castel | |
| 4,821,437 A | | 4/1989 | Abramson et al. | |
| 5,197,215 A | | 3/1993 | Torsleff | |
| 5,392,547 A | | 2/1995 | Mason | |
| 5,488,793 A | | 2/1996 | Gebka et al. | |
| 5,515,632 A | | 5/1996 | Gebka et al. | |
| 5,863,019 A | | 1/1999 | Rose et al. | |
| 5,899,011 A | | 5/1999 | Brinkman | |
| 5,967,343 A | | 10/1999 | Dufresne | |
| 5,992,072 A | | 11/1999 | Garfinkle | |
| 6,026,603 A | | 2/2000 | Kump et al. | |
| 6,035,569 A | | 3/2000 | Nagel et al. | |
| 6,119,990 A | * | 9/2000 | Kump et al. | 211/57.1 |
| 6,189,248 B1 | * | 2/2001 | Nagel et al. | 248/222.51 |
| 6,226,910 B1 | * | 5/2001 | Ireland | 40/651 |

* cited by examiner

*Primary Examiner*—S. Joseph Morano
*Assistant Examiner*—Jason R. Bellinger
(74) *Attorney, Agent, or Firm*—Arthur Jacob

(57) ABSTRACT

A shelf product management and information display identifies a product allocated to a portion of a shelf at a point of purchase and provides a purchaser with extended information pertaining to the product. The display is to be mounted at the forward edge of the shelf portion and includes a channel for displaying information pertaining to the identification and pricing of the allocated product, and a cover element which carries graphic material in the form of aesthetically pleasing product identification and logo representations. The cover element is maintained in a closed position by the force of gravity, and is selectively moved to an open position to reveal extended information pertaining to the allocated product, which extended information is hidden from view when the cover element is in the closed position. A catch mechanism holds the cover element in the open position so that a purchaser conveniently may review the extended information, and is released readily to bias the cover element toward the closed position.

11 Claims, 3 Drawing Sheets

SHELF PRODUCT MANAGEMENT AND INFORMATION DISPLAY

BACKGROUND OF THE INVENTION

The present invention relates generally to the presentation of products on a shelf at a point of purchase and pertains, more specifically, to a shelf product management and information display for identifying product allocated to a portion of a shelf at a point of purchase and for providing a purchaser with extended information pertaining to the allocated product.

The increasing number and variety of products offered to purchasers on shelves placed at points of purchase can engender confusion and even frustration in a purchaser attempting to distinguish between various brands when selecting a product for purchase. Consequently, the more product information which can be presented to a potential purchaser at the point of purchase of a particular product, the more likely it becomes that the informed purchaser will choose to purchase that product. It would be advantageous, then, to have available a display which can provide a maximum amount of information, presented in an aesthetically pleasing and non-overwhelming manner, in a minimal amount of space, so as to be adapted readily to commonly available shelf arrangements.

Further, the demands for shelf space, especially at certain retail outlets, requires careful management of available shelf space so that products allocated to specific shelf areas always are placed and replaced with accuracy and care. In addition, effective management of available shelf space requires the ability to change space allocation with ease, and any associated display information should be amenable to ready change to accommodate a change in the product allocated to a given shelf space.

BRIEF DESCRIPTION OF THE INVENTION

The present invention facilitates the management of products allocated to specified shelf areas while providing potential purchasers with extended product information presented in an appealing manner within the confines of the limited space ordinarily available at such locations. As such, the present invention attains several objects and advantages, some of which are summarized as follows: Accomplishes effective management of products placed on shelves at points of purchase through the provision of adequate product identification information at the shelf space allocated to the product, utilizing minimal display space; provides extended product information for review by a potential purchaser directly at the point of purchase of the product, with minimal encroachment upon shelf space; presents an aesthetically pleasing and non-invasive display of comprehensive information pertaining to a product placed on a shelf at a point of purchase, directly at the point of purchase; provides an ergonomic display readily utilized by purchasers to obtain extensive product information quickly and with ease, thereby encouraging purchasers to select the product identified in the display; allows ease of changing the information displayed at a particular point of purchase so as to maintain current the information pertaining to a particular product offered at that point of purchase; provides a relatively simple and economical display compatible with and readily installed at convenient locations on conventional shelving for exemplary long-term performance.

The above objects and advantages, as well as further objects and advantages, are attained by the present invention which may be described briefly as a shelf product management and information display for identifying product allocated to a portion of a shelf at a point of purchase and for providing a purchaser with extended information pertaining to the allocated product, the display comprising: an elongate basal element for extending longitudinally along a portion of a shelf at a point of purchase, adjacent a front edge of the shelf, the basal element including a forward edge for extending adjacent the front edge of the shelf, and a rearward edge laterally opposite the forward edge; a channel element extending longitudinally adjacent the forward edge of the basal element; a first display area extending along the channel element for carrying information pertaining to product allocated to the portion of the shelf; a wall element extending longitudinally adjacent the rearward edge of the basal element and spaced laterally from the forward edge, the wall element having an altitudinally upper portion; a second display area extending longitudinally along the basal element and located between the forward edge and the rearward edge of the basal element for carrying extended information pertaining to the allocated product; a cover element extending longitudinally in juxtaposition with the basal member, the cover element having a forward border and laterally opposite rearward border, an obverse face located laterally between the forward border and the rearward border, and a reverse face located laterally between the forward border and the rearward border; a third display area extending along the obverse face of the cover element for carrying further information pertaining to the allocated product; a fourth display area extending along the reverse face of the cover element for carrying further extended information pertaining to the allocated product; a hinge connecting the cover element with the altitudinally upper portion of the wall element for selective movement of the cover element between a closed position wherein the cover element overlies the basal element, with the fourth display area confronting the second display area and both the fourth display area and the second display area hidden from view, while the first display area and the third display area are available for view, and an open position wherein the cover element is raised altitudinally away from the basal element to expose the fourth display area and the second display area for view; and a mounting arrangement on the basal element for securing the basal element to the shelf.

BRIEF DESCRIPTION OF THE DRAWINGS

The invention will be understood more fully, while still further objects and advantages will become apparent, in the following detailed description of a preferred embodiment of the invention illustrated in the accompanying drawing, in which.

DETAILED DESCRIPTION OF THE INVENTION

Figure 1:
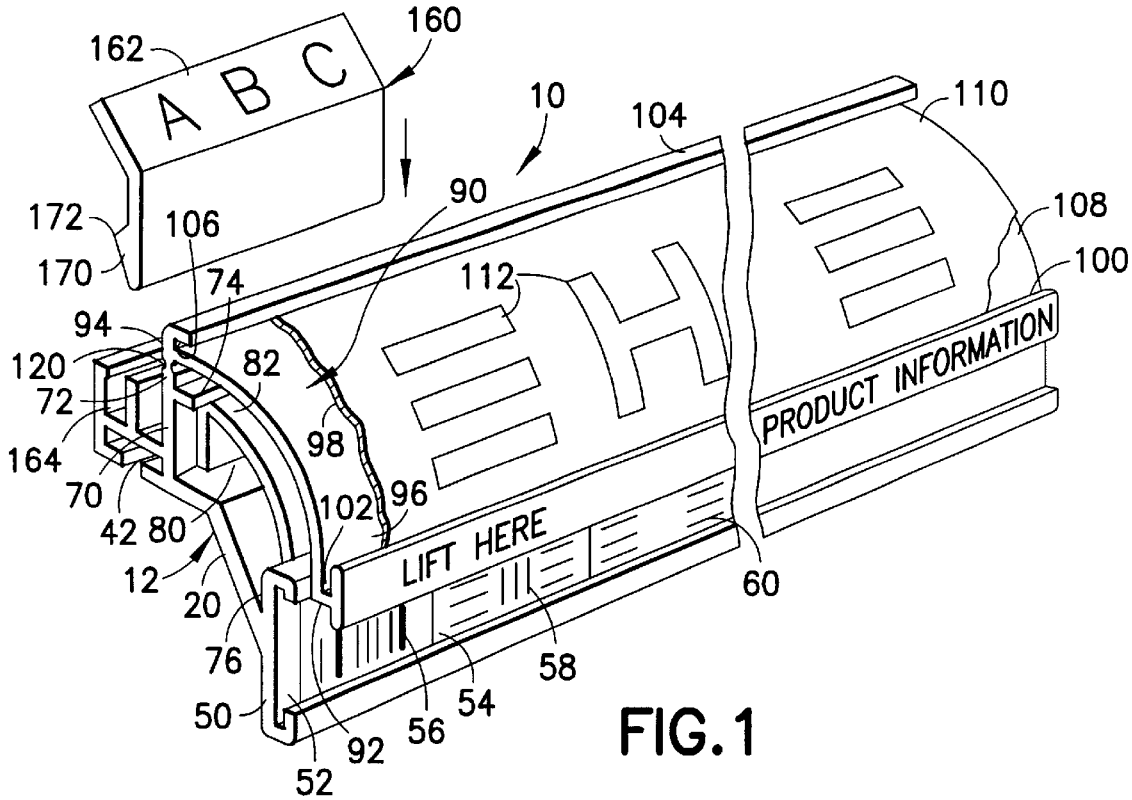
FIG. 1 is an exploded perspective view of a shelf product management and information display constructed in accordance with the present invention.
Figure 2:
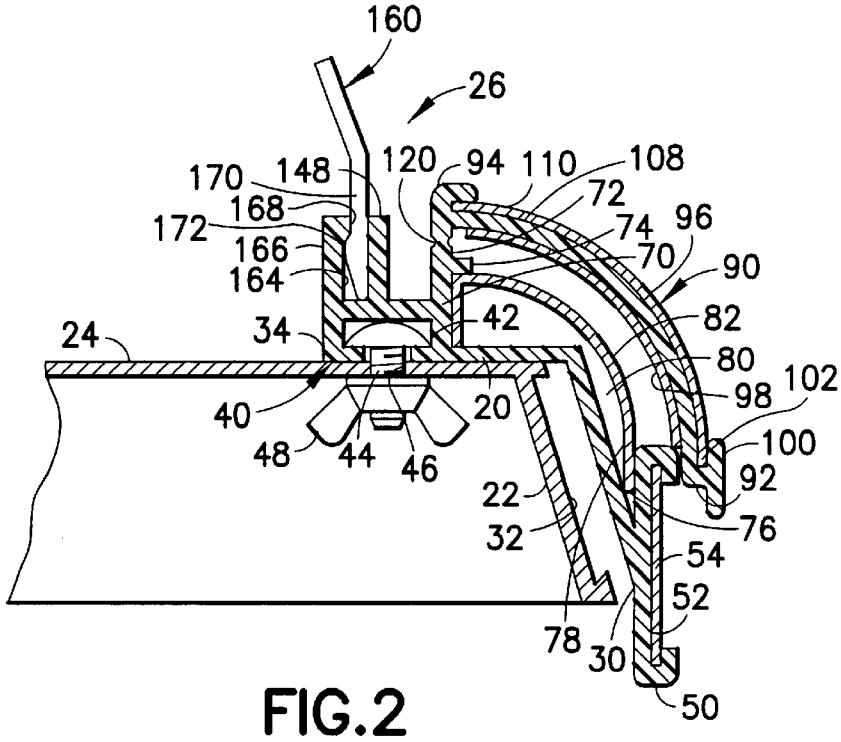
FIG. 2 is an enlarged lateral cross-sectional view of the display installed on a shelf at a point of purchase.

Referring now to the drawing, and especially to FIGS. 1 and 2 thereof, a shelf product management and information display constructed in accordance with the present invention is shown at 10 and is seen to include an elongate body member 12, preferably constructed in a one-piece, longitudinally extending unitary extrusion of synthetic polymeric material, such as polystyrene. Body member 12 is comprised of a plurality of structural elements, including an elongate basal element 20 for extending longitudinally along a portion 22 of a shelf 24 at a point of purchase 26. Basal element 20 includes a forward edge 30 for extending adjacent front edge 32 of the shelf 24, and a rearward edge 34 laterally opposite the forward edge 30. A mounting arrangement 40 is placed adjacent the rearward edge 34 and includes a slot 42 having a T-shaped cross-sectional configuration for capturing mounting bolts 44 spaced longitudinally along the length of slot 42 so as to pass through holes 46 provided in the shelf 24 and receive wing-nuts 48 for securing the basal element 20 to the shelf 24.

A channel element 50 extends longitudinally adjacent forward edge 30 of the basal element 20 so as to be placed adjacent the front edge 32 of shelf 24. A first display area 52 extends along the channel element 50 for the reception of cards, tags or labels which carry information pertaining to the product allocated to the portion 22 of shelf 24. One such label is shown at 54 and is seen to include product identification information in the form of a UPC (Universal Product Code) imprint 56, a price 58 and a product name 60. In the illustrated preferred construction, channel element 50 is unitary with basal element 20.

A wall element 70 extends longitudinally along the basal element 20, adjacent the rearward edge 34 of the basal element 20, spaced laterally from the forward edge 30. Wall element 70 projects altitudinally upwardly from the basal element 20 to an altitudinally upper portion 72 of wall element 70. A first retention element is shown in the form of a retention rib 74 extending longitudinally along the wall element 70, and a second retention element is shown in the form of a retention groove 76 extending longitudinally along the basal element 20, located laterally between the forward edge 30 of the basal element 20 and the rearward surface 78 of the channel element 50, so as to establish a second display area 80 extending longitudinally along the basal element 20, between the retention rib 74 and the retention groove 76. A graphic display card 82 carries extended information pertaining to the product allocated to portion 22 of shelf 24 and is inserted and retained between the retention rib 74 and the retention groove 76 so as to display the extended product information throughout the second display area 80.

A cover element 90 extends longitudinally in juxtaposition with the basal element 20 and has a forward border 92, a laterally opposite rearward border 94, an obverse face 96 and a reverse face 98, both faces 96 and 98 being located laterally between the forward border 92 and the rearward border 94. A bar 100 extends longitudinally along the forward border 94 and is spaced laterally from the obverse face 96 to establish a forward slot 102. Likewise, a ledge 104 extends longitudinally along the rearward border 94 and is spaced laterally from the obverse face 96 to establish a rearward slot 106. Cover element 90 includes a curved profile contour, the cover element 90 having an essentially arcuate lateral cross-sectional configuration, so that the forward and rearward slots 102 and 106, together with the obverse face 96, establish a laterally curved, longitudinally extending third display area in the form of a display channel 108. A graphic display card 110 is fitted within display channel 108 and carries further information pertaining to the allocated product; in this instance, the further information being in the form of the product name and logo 112 displayed in an aesthetically attractive fashion.

Figure 3:
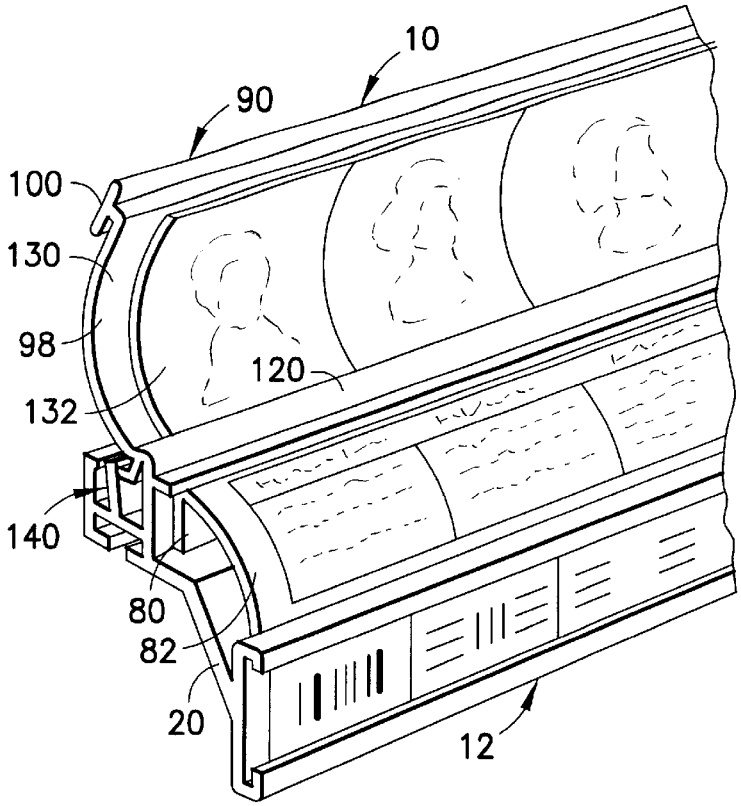
FIG. 3 is a fragmentary perspective view, similar to FIG. 1, showing elements of the display in another position.
Figure 4:
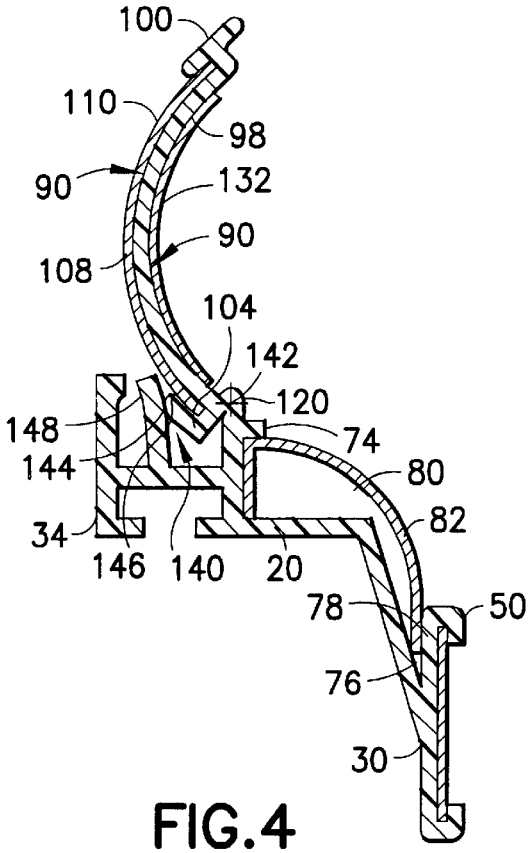
FIG. 4 is a lateral cross-sectional view similar to FIG. 2, showing elements of the display in the position illustrated in FIG. 3.

A hinge is shown in the form of an integral hinge 120 located at the upper portion 72 of wall element 70 and connecting the wall element 70 with the cover element 90, adjacent the rearward border 94 of the cover element 70. Hinge 120 preferably is a "living hinge" formed integral with the extruded body member 12. In the illustrated preferred embodiment, hinge 120 is constructed of a polystyrene sold under the trademark KRATON, which material is particularly well-suited to serve as a living hinge, and is coextruded with the polystyrene material utilized for the remaining elements of the body member 12. As best seen in FIGS. 3 and 4, as well as in FIGS. 1 and 2, hinge 120 connects cover element 90 with wall element 70 for selective movement between a closed position, as seen in FIGS. 1 and 2, and an open position, as illustrated in FIGS. 3 and 4. In the closed position, cover element 90 overlies basal element 20 and covers second display area 80 so that graphic display card 82 is hidden from view. In this manner display 10 presents an uncluttered, aesthetically appealing appearance in which a purchaser is presented with the attractive product name and logo 112 displayed at the third display area along the obverse face 96 of the cover element 90. At the same time, certain identification information is available at the first display area 52 along the channel element 50.

Having identified the allocated product, a purchaser can obtain more extensive information pertaining to the allocated product by merely lifting the cover element 90 to the open position illustrated in FIGS. 3 and 4. Thus, the purchaser, having been attracted by the display at the third display area along the obverse face 96 of the cover element 90, can grasp the bar 100 and lift the cover element 90 from the closed position to the open position, thereby exposing for view not only the second display area 80, and the extended product information displayed on card 82, but also exposing for view a fourth display area 130 extending along the reverse face 98 of cover element 90. A graphic display card 132 is adhered to the reverse face 98 and, together with the graphic display card 82, provides comprehensive and extensive product information for ready review by the prospective purchaser.

Figure 5:
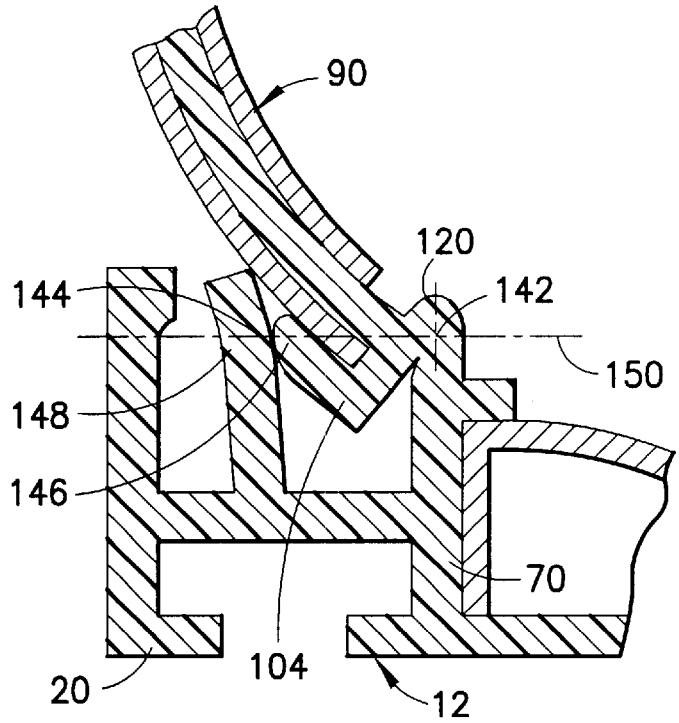
FIG. 5 is an enlarged fragmentary lateral cross-sectional view, partially diagrammatic, of a portion of FIG. 4.

The cover element 90 is maintained selectively in the open position by a catch mechanism 140 which operates in concert with the hinge 120 to either hold the cover element 90 in the open position or bias the cover element 90 toward the closed position. The cover element 90 normally is maintained in the closed position by the force of gravity, the hinge 120 being placed at the altitudinally upper portion 72 of wall element 70 so that the cover element 90 depends from the upper portion 72. As the cover element 90 is lifted, the cover element 90 rotates about a hinge axis 142, bringing a first catch element in the form of a rounded surface 144 along the lip 146 of the ledge 104 into contact with a second catch element in the form of a resiliently deflectable member illustrated as a cantilever 148 extending longitudinally along the basal element 20 and projecting altitudinally upwardly, spaced laterally from the wall element 70. As best seen in FIG. 5, when the lip 146 falls below the level 150 of the hinge axis 142, the resilient biasing force of the cantilever 148 serves as an over-center spring force tending to bias the cover element 90 into the open position. When it is desired to move the cover element 90 to the closed position, the bar

Figure 6:
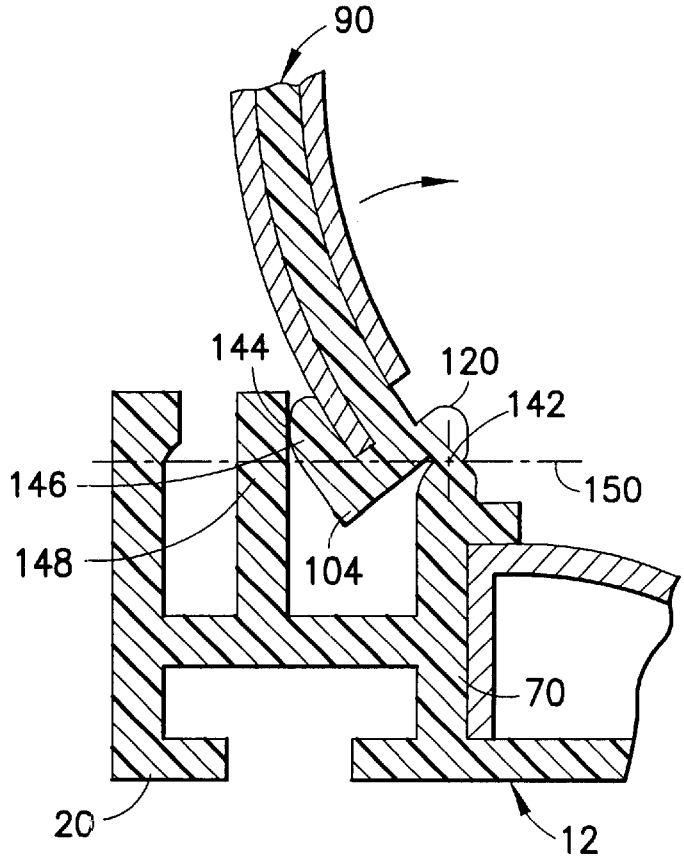
FIG. 6 is an enlarged fragmentary lateral cross-sectional view similar to FIG. 5, showing elements in another position.

100 is pulled downwardly, thereby moving the lip 146 upwardly against the bias of the over-center spring force. Once the lip 146 passes upwardly beyond the level 150 of the hinge axis 142, as illustrated in FIG. 6, the over-center spring force provided by the cantilever 148 biases the cover element 90 toward the closed position. The force of gravity then maintains the cover element 90 in the closed position. Thus, the relative location of the hinge axis 142, the lip 146 and the cantilever 148 enables the resilient biasing force provided by cantilever 148 to selectively bias the cover element 90 toward either the open position or the closed position. The construction of catch mechanism 140 enables the catch mechanism 140 to be incorporated readily into the extruded one-piece structure of body member 12.

Returning now to FIGS. 1 and 2, as an added option, a supplemental display plaque 160 may be coupled to the body member 12 for providing a further display area 162, further calling attention to a particular product or a particular attribute of the allocated product. A first coupling element is shown in the form of a slot 164 extending longitudinally along the basal element 20 and placed laterally between the cantilever 148 and an altitudinally projecting web 166 carrying a first detent element 168. The display plaque 160 includes a second coupling element in the form of a depending blade 170 carrying a second detent element 172. Display plaque 160 is coupled to basal element 20 at any selected longitudinal location along the display 10 merely by inserting blade 170 into slot 164 to engage the detent elements 168 and 172 and thereby secure the display plaque 160 at the selected location.

Display 10 can be constructed in any desired length, thereby accommodating a shelf portion 22 of any length associated with any allocated shelf space encountered in the field. Labels 54 and graphic display cards 82, 110 and 132 are removed and replaced easily so as to readily accommodate any changes in the product allocated to the shelf space associated with display 10.

It will be seen that the present invention attains the several objects and advantages summarized above, namely: Accomplishes effective management of products placed on shelves at points of purchase through the provision of adequate product identification information at the shelf space allocated to the product, utilizing minimal display space; provides extended product information for review by a potential purchaser directly at the point of purchase of the product, with minimal encroachment upon shelf space; presents an aesthetically pleasing and non-invasive display of comprehensive information pertaining to a product placed on a shelf at a point of purchase, directly at the point of purchase; provides an ergonomic display readily utilized by purchasers to obtain extensive product information quickly and with ease, thereby encouraging purchasers to select the product identified in the display; allows ease of changing the information displayed at a particular point of purchase so as to maintain current the information pertaining to a particular product offered at that point of purchase; provides a relatively simple and economical display compatible with and readily installed at convenient locations on conventional shelving for exemplary long-term performance.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A shelf product management and information display for identifying product allocated to a portion of a shelf at a point of purchase and for providing a purchaser with extended information pertaining to the allocated product, the display comprising:

an elongate basal element for extending longitudinally along a portion of a shelf at a point of purchase, adjacent a front edge of the shelf, the basal element including a forward edge for extending adjacent the front edge of the shelf, and a rearward edge laterally opposite the forward edge;

a channel element extending longitudinally adjacent the forward edge of the basal element;

a first display area extending along the channel element for carrying information pertaining to product allocated to the portion of the shelf;

a wall element extending longitudinally adjacent the rearward edge of the basal element and spaced laterally from the forward edge, the wall element having an altitudinally upper portion;

a second display area extending longitudinally along the basal element and located between the forward edge and the rearward edge of the basal element for carrying extended information pertaining to the allocated product;

a cover element extending longitudinally in juxtaposition with the basal member, the cover element having a forward border and laterally opposite rearward border, an obverse face located laterally between the forward border and the rearward border, and a reverse face located laterally between the forward border and the rearward border;

a third display area extending along the obverse face of the cover element for carrying further information pertaining to the allocated product;

a fourth display area extending along the reverse face of the cover element for carrying further extended information pertaining to the allocated product;

a hinge connecting the cover element with the altitudinally upper portion of the wall element for selective movement of the cover element between a closed position wherein the cover element overlies the basal element, with the fourth display area confronting the second display area and both the fourth display area and the second display area hidden from view, while the first display area and the third display area are available for view, and an open position wherein the cover element is raised altitudinally away from the basal element to expose the fourth display area and the second display area for view; and a mounting arrangement on the basal element for securing the basal element to the shelf.

2. The invention of claim 1 wherein the basal element, the channel element, the wall element, the cover element, the hinge and the mounting arrangement comprise a unitary member of synthetic polymeric material.

3. The invention of claim 1 including a first catch element on the cover element for selectively maintaining the cover element in the open position.

4. The invention of claim 3 including a second catch element on the basal element for being engaged by the first catch element, when the cover element is in the open position, to selectively maintain the cover element in the open position.

5. The invention of claim 4 wherein the first catch element is located adjacent the rearward border of the cover element and the second catch element is located adjacent the rearward edge of the basal element.

6. The invention of claim 5 wherein the hinge includes a longitudinally extending hinge axis, and the second catch element includes a resiliently deflectable member for exerting a resilient biasing force when engaged by the first catch element, the relative location of the first catch element, the second catch element and the hinge axis being such that the resilient biasing force selectively biases the cover element toward either one of the open position and the closed position.

7. The invention of claim 6 wherein the basal element, the channel element, the wall element, the cover element, the first catch element, the second catch element, the hinge and the mounting arrangement comprise a unitary member of synthetic polymeric material.

8. The invention of claim 1 wherein the third display area includes a display channel extending longitudinally along the obverse face of the cover element for retaining a selected display member at the obverse face.

9. The invention of claim 1 wherein the basal element includes a first retention element along the forward edge and a second retention element along the rearward edge, the first and second retention elements comprising a display retainer for retaining a further selected display member at the second display area.

10. The invention of claim 9 wherein the basal element, the channel element, the wall element, the cover element, the first retention element, the second retention element, the hinge and the mounting arrangement comprise a unitary member of synthetic polymeric material.

11. The invention of claim 1 wherein the basal element includes a first coupling element extending longitudinally along the basal element adjacent the rearward edge, and a display plaque having a second coupling element complementary to the first coupling element for selective coupling of the display plaque with the basal element, the display plaque including a further display area for carrying still further information pertaining to the allocated product.

* * * * *